US005666772A

United States Patent [19]

Betty

[11] Patent Number: 5,666,772

[45] Date of Patent: Sep. 16, 1997

[54] PATIO/FLOOR ASSEMBLY

[76] Inventor: Paul L. Betty, 220 W. Longspur Dr., Wilmington, Del. 19808

[21] Appl. No.: 336,046

[22] Filed: Nov. 4, 1994

[51] Int. Cl.[6] ..... E04F 15/22

[52] U.S. Cl. ..... 52/177; 52/480; 52/180; 52/302.1

[58] Field of Search ..... 52/302.1, 480, 52/177, 180

[56] References Cited

U.S. PATENT DOCUMENTS

| | | | |
|---|---|---|---|
| 3,438,312 | 4/1969 | Becker et al. | 52/177 |
| 4,126,006 | 11/1978 | Lewis | 52/177 X |
| 4,287,693 | 9/1981 | Collette | 52/302.1 X |
| 4,478,901 | 10/1984 | Dickens et al. | 52/177 X |
| 4,637,184 | 1/1987 | Radtke et al. | 52/302.1 X |
| 4,648,592 | 3/1987 | Harinishi | 52/480 X |
| 4,930,286 | 6/1990 | Kotler | 52/177 |
| 4,945,697 | 8/1990 | Ott et al. | 52/480 X |
| 5,274,977 | 1/1994 | Bayly | 52/480 |
| 5,323,575 | 6/1994 | Yeh | 52/489.1 X |
| 5,363,614 | 11/1994 | Faulkner | 52/480 X |
| 5,509,244 | 4/1996 | Bentzon | 52/177 X |
| 5,511,353 | 4/1996 | Jones | 52/489.1 X |

*Primary Examiner*—Carl D. Friedman
*Assistant Examiner*—W. Glenn Edwards

[57] ABSTRACT

A patio/floor assembly comprising interlocking plastic blocks with open drainage spaces which form a base for porous indoor/outdoor carpeting is disclosed. The carpet assembly allows the drainage of water through the carpet and plastic blocks and away from bottom of the patio/floor assembly. This avoids a build up of minerals on the substrate concrete of patios, decks, and balconies and avoids cracking of the concrete or damage to the permanent deck.

3 Claims, 1 Drawing Sheet

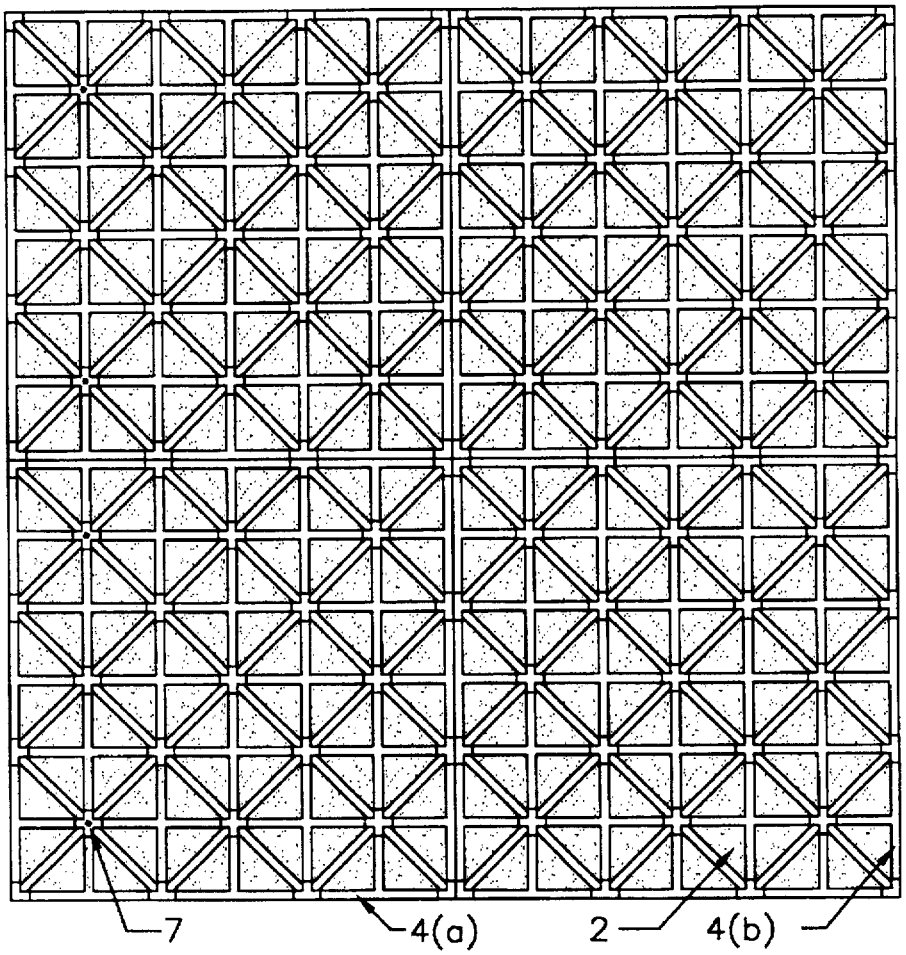
FIGURE II
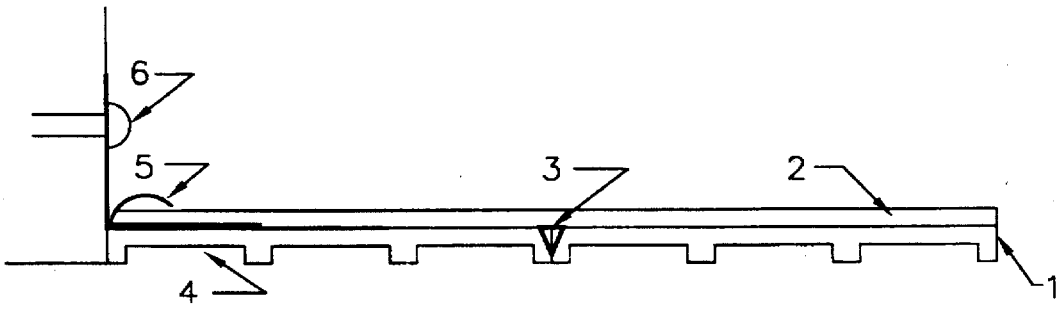
FIGURE I

PATIO/FLOOR ASSEMBLY

BACKGROUND OF THE INVENTION

The present invention relates to carpet assembly coverings for decks, patios, balconies and pool decks. A need for proper drainage to prevent damage to the deck surface, be it concrete or wood, due to collection of moisture and salts, is required where a carpet is to be installed on balconies, decks, concrete floors and around pools. This invention relates to a system whereby a multiple layered covering is utilized; the bottom layer of said coverings are interlocking plastic tiles constructed in the manner which will allow moisture to be channeled and freely flow away from the underside of the tiles. The upper surface of said interlocking tiles is flat to accommodate carpet of the self draining type, which is secured to said tiles, so that the carpeting does not move or lift. The entire assembly can expand and contract in response to temperature variation without buckling.

This invention utilizes interlocking tiles, which when fastened together become a ridged substrate for the carpeting, which will not buckle but can be easily assembled to the shape of the patio or balcony upon which carpeting it desired. The carpeting itself will be a polypropylene or polyethylene mat which would allow moisture to penetrate to the tile level and be drained away.

DESCRIPTION OF PRIOR ART

Heretofore, when one wished to have a carpet on a balcony, such as in a high rise apartment or surrounding a pool, or on a deck, one would buy an indoor/outdoor carpet which can take heat, cold and the elements. Said carpet would be either glued down or would be laid without glue and tacked to the perimeter. Said carpets were usually porous, allowing moisture to drain. Some of said carpets had channeling affects within the carpet. However, all of the indoor/outdoor carpets, to a lessor or greater extent, allowed the retention of moisture between the balcony or patio surface and the carpet. This caused a build up of salts resulting in cracking of the concrete substrate or creation of mold and rot in the wood and carpet. Relevant art include U.S. Pat. Nos.: 4,584,221; 5,170,601; 4,946719, 4,226,064; 4,172,168; British Patent No.: 1,442,806 and Japanese Patent No.: 2-112,505.

A carpet assembly which would not collect moisture retain moisture and cause a building up of salts has not been demonstrated in the art.

SUMMARY OF THE INVENTION:

It is the general objective of the present invention to provide a covering assembly which will eliminate the trapping or collection of moisture between the carpet and the original concrete or wood balcony or deck or substrate; it is another objective is to provide said covering assembly to avoid buckling. A further objective is to have a patio covering assembly which has a plurality of plastic interlocking blocks which form a base for porous indoor/outdoor carpeting that will stay in place and be easily shaped to whatever dimension the patio or deck requires, allowing utilization of carpeting of the porous polypropylene or polyethylene construction; a further objective of this invention is to provide the property owner the advantage a carpeted surface, without any of the disadvantage of destruction of the concrete or wood deck which is in place.

It is well known that with indoor/outdoor carpeted situations, salts and acids from the rain and natural elements accumulate in the carpet and the residual moisture will cause a high concentration of said acids and salts to be in contact with the concrete. This process causes the cracking and deterioration of the concrete. By the system embodied herein, because the carpet is removed from direct contact with the concrete and salts will not build up, such chemical decomposition is avoided. In fact, when rain falls it will wash through the carpet causing the salts and acids to be removed and drained away without injury to the concrete or wood substrate.

BRIEF DESCRIPTION OF THE DRAWINGS:

FIGURE I: Is a cross-sectional view of the carpet tile system of this invention. Item 1 is the tile; Item 2 is the carpet.

FIGURE II: Shows the view of the assembled system from below showing greater detail of the interlocking tiles.

DETAILED DESCRIPTION OF THE PREFERRED EMBODIMENT

FIGURE I: Illustrates the cross-sectional of the preferred embodiment. It shows the following: the structure of the plastic substrate interlocking with the next tile, Item 3 being the interlocking mechanism. It shows the channeling between all tiles, with space labeled as Item 4(*a*). It shows the securing of the carpeting to the peripheral of the entire assembly tile by Item 5 which for this purpose is considered a tacking means. Further, for balconies installations, Item 6 is a means by which the interlocking tiles are secured to the railing of said balcony. Item 6 eliminates any hazard of the assembly slipping under the balcony railing or moving on the balcony. Said interlock, is only used where a balcony railing is utilized. Where solid balcony walls are in place, said interlock is not an essential part of the invention.

FIGURE II: Illustrates all of the elements of the invention in a plan view, rather than sectional view. The cross hatching and drainage of the tiles is evident by the number of open drainage spaces Items 4(*a*) and 4(*b*). Furthermore, it is clear that the upper surface of the tiles are on open lattice, which support the carpet but allow drainage through the carpet, through the tiles, and off the patio or building. Item 7 is used to fasten Item 5 to the tiles.

Although shown and described in the preferred embodiment, it is to be distinctly understood that the invention is not meant to be limited hereto. Thus, the specific lattice or arrangement of the tiles shown in FIGURE II can be modified to form similar lattices of many other designs, but said design is not a functional part of the invention. However, there must be sufficient openings in each tile to allow drainage from the carpeting above, and still support the carpet in a flat unwrinkled installation. Likewise, although the channeling is shown, it may be that the channeling will be accomplished only in every other tile in lateral and vertical directions, thereby giving more strength to the entire assembly, but always allowing full flow and drainage of fluids through the carpeting and away from the underside of the assembly, thus avoiding a build up of salts and acids on the concrete surface.

HAVING THIS DESCRIBED THE INVENTION, I claim as follows:

1. A patio floor assembly comprising a plurality of rectangular plastic tiles which are interconnected with a small clearance between each adjacent tiles, each tiles having and being supported on supports which have openings between said supports for channels so that when said openings are arranged, there are multiple channels for fluids to drain away from the underside of said tiles; each tile also having a lattice surface with multiple openings to allow fluid to easily access the channels below without being trapped on the top of said plastic tiles; a permeable carpeting of polypropylene or polyethylene adapted to lay on top of said tiles and be held in place by tacking means; each of said tacking means being attachable to said plastic tiles to hold the carpet in place.

2. The patio covering assembly of claim 1, in which the plastic rectangular tiles are provided with an interlock adapted to attach to open railings of patios to secure said assembly from movement off of said patio.

3. A method of installation of outdoor water permeable carpeting which comprises, (a) the laying of a sub-floor of interconnecting plastic members as described in claim 1 herein, which members form a uniform and secure substrate attachable to the railings of patios and whose upper surface is porous and will allow the installation of carpeting of permeable polyethylene or polypropylene; b securing of said carpeting to the substrate tiles and, thus, eliminating the contact of the carpeting with the concrete patio or deck surface and allowing for free flow of fluids through the carpeting and off of the deck without any trapping between the carpeting and the deck surface.

* * * * *